US005955694A

United States Patent [19]

Sakurai

[11] Patent Number: 5,955,694

[45] Date of Patent: Sep. 21, 1999

[54] ATTACHMENT STRUCTURE FOR PICK-UP DEVICE IN ELECTRICAL STRINGED MUSICAL INSTRUMENT

[75] Inventor: Hiroshi Sakurai, Hamamatsu, Japan

[73] Assignee: Yamaha Corporation, Shizuoka, Japan

[21] Appl. No.: 09/031,571

[22] Filed: Feb. 26, 1998

[30] Foreign Application Priority Data

Feb. 27, 1997 [JP] Japan ..... 9-43377

[51] Int. Cl.[6] ..... G10H 3/18

[52] U.S. Cl. ..... 84/743

[58] Field of Search ..... 84/723, 724, 727, 84/731, 733–746

[56] References Cited

U.S. PATENT DOCUMENTS 3,535,968 10/1970 Rickard ..... 84/727

4,184,399 1/1980 Zuniga ..... 84/727

5,567,903 10/1996 Coopersmith et al. ..... 84/743 X

*Primary Examiner*—Stanley J. Witkowski

*Attorney, Agent, or Firm*—Koda & Androlia

[57] ABSTRACT

In a structure for mounting a pick-up device in an electrical stringed musical instrument such as an electric guitar, the pick-up device being installed in a metal-made casing along with a string carrier. The casing is accommodated inside a through-hole formed in a lower bridge attached on the outer surface of the front board of the instrument so that the casing can be raised and lowered. The casing has adjustment screws, and these adjustment screws are screwed into screw holes formed in a plate member installed on the inner surface of the front board. When the adjustment screws are rotated, the casing is moved upward or downward inside the accommodating section; as a result, the height of strings supported on the string carrier installed in the casing can be adjusted.

5 Claims, 2 Drawing Sheets

ATTACHMENT STRUCTURE FOR PICK-UP DEVICE IN ELECTRICAL STRINGED MUSICAL INSTRUMENT

BACKGROUND OF THE INVENTION

1. Field of the Invention

The present invention relates to an attachment structure for a pick-up device used in an electrical stringed musical instrument such as an electric guitar, etc.

2. Prior Art

FIG. 5 shows a cross-section of the attachment structure of a pick-up device used in a conventional acoustic or semi-acoustic electric guitar.

In FIG. 5, the reference numeral 1A is a front board or sounding board which forms the front surface of a hollow resonating body 1 of a guitar. A lower bridge 3 is fastened to the outer surface of the front board 1A so that the strings 2 are installed in the perpendicular direction thereof. In addition, piezo-type pick-ups 4A and 4B for picking up the sound of low-notes (of the low-note strings) and high-notes (of the high-note strings) respectively are fastened to the inner surface of the front board 1A with a lower bridge reinforcing plate 5 in between. The pick-ups 4A and 4B are installed at a location positionally corresponding to the lower bridge 3.

Each one of the piezo-type pick-ups 4A and 4B is covered with a covering 6 that is made of an ABS resin, etc., and the covering 6 is fastened to the lower bridge reinforcing plate 5 by putty 7. Putty 7 is used because a high-viscosity putty is effective in allowing the piezo-type pick-ups 4A and 4B to pick up the vibrations of the front board directly.

The reference numeral 8 in FIG. 5 is a string-carrying member or string carrier that is called a "saddle", and the string-carrying member 8 supports a plurality of strings 2 on its upper surface. This string-carrying member 8 is installed, together with a pick-up device 10 which converts the vibrations of the strings 2 into electrical signals, in an accommodating section 9 which is a recess formed in the center of the upper surface the lower bridge 3. The pick-up device 10 includes a long, slender piezo-electric element that faces the respective strings 2 and is formed in a band-shape so that it can face all the strings 2. In addition, the pick-up device 10 is connected to an electric circuit (not shown) via a cable 11.

As seen from the above, the pick-up device 10 and string-carrying member 8 of the conventional guitar are accommodated inside the accommodating section 9 formed in the lower bridge 3 and pressed by the strings 2.

However, the lower bridge 3 is ordinarily made of wood, and it is difficult to form the inside bottom surface of the accommodating section 9 of the lower bridge (against which the pick-up device 10 is tightly pressed) with a high degree of flatness. In cases where the flatness degree is low, it is difficult to pick up clean harmonious sounds; on the other hand, finishing the inside bottom surface to a high degree of flatness requires considerable skill and effort.

Furthermore, the height of the strings 2 may change due to deformation of the front board and neck (not shown) of the guitar, and this causes problems in terms of tone color, sound volume, playing characteristics, etc. The only way to solve such a problem in the prior art instrument is to adjust the height of the strings 2 by planing the string-carrying member 8. However, the planing of the string-carrying member 8 also requires a high degree of skill; and if such an adjustment is necessary just before playing in a concert, etc., there is no way to make such an immediate adjustment. Furthermore, since the piezo-type pick-ups 4A and 4B are fastened to the front board 1A by putty 7, vibration in the front board 1A may cause the putty 7 to peel off; and in addition, since the piezo-type pick-ups directly pick up vibrations of the front board, the sound would vary depending upon the type and manner of attachment of these pick-ups by the putty, and uniform quality sound cannot be obtained.

SUMMARY OF THE INVENTION

Accordingly, the primary object of the present invention is to solve the problems above with the conventional instruments.

It is another object of the present invention to provide an attachment structure for a pick-up device in an electrical stringed musical instrument in which the height of the string-carrying member can easily be adjusted with no need for any special skill and with no need for any planing of the string-carrying member.

It is still another object of the present invention is to provide a pick-up attachment structure in an electrical stringed musical instrument which picks up sound inside the body of the instrument in an acoustically stable fashion.

The objects of the present invention are accomplished by a unique attachment structure for a pick-up device for an electrical stringed musical instrument in which a pick-up device and a string-carrier are provided inside an accommodating section of a lower bridge that is fastened to the front board of the instrument, and strings are supported on the upper surface of the string-carrier, wherein the attachment structure includes a casing, which is accommodated inside the accommodating section of the lower bridge so that it can be raised and lowered, and a height adjustment means, which can adjust the height of the casing; and the pick-up device and string-carrier are installed inside this casing.

Furthermore, a plate member which is made of metal is fastened to the inner surface of the front board so as to positionally correspond to the lower bridge, and adjustment screws which are the height adjustment means are screwed into this plate member; and in addition, microphones are attached to the plate member.

In the structure described above, the casing, which has the pick-up device and string-carrier, is accommodated inside the accommodating section of the lower bridge. Accordingly, the height adjustment means (or the adjustment screws) can adjust the height of the casing, and therefore, the height of the strings on the front board can be adjusted by the height adjustment means.

As a result, there is no need to adjust the height of the string-carrier by planing, and the casing can be supported stably by the height adjustment means (the adjustment screws) screwed into the plate member which is made of metal.

Furthermore, the pick-up device which is installed inside the casing is mounted to the plate member stably and therefore is less likely to come off. In addition, the attachment structure of the present invention is provided with a microphone unit, microphones are securely attached to this microphone unit. Accordingly, the microphones are also less likely to come off, and the assembly is easier.

DETAILED DESCRIPTION OF THE INVENTION

Figure 5:
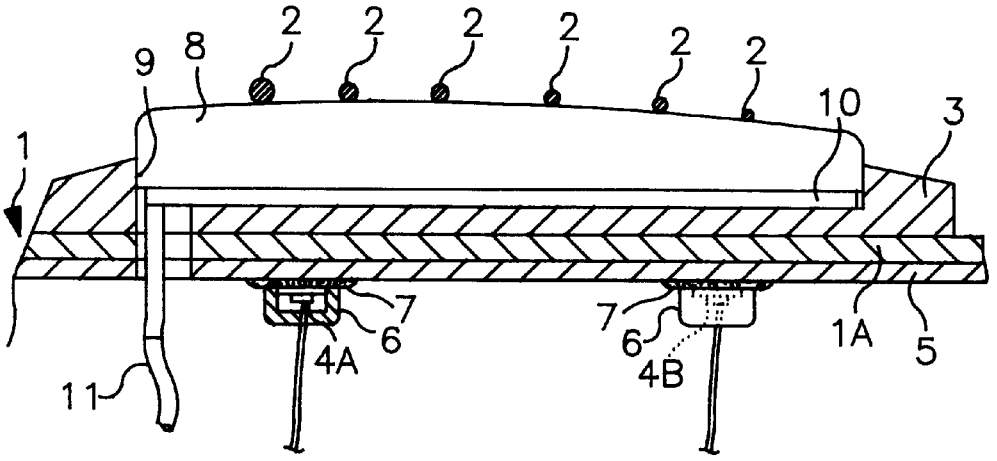
FIG. 5 PRIOR ART
FIG. 5 is a sectional view of a conventional pick-up device attachment structure.

One embodiment of the present invention will be described in greater detail below with reference to FIGS. 1 through 4. The constituting elements which are the same as those in the prior art of FIG. 5 are indicated by the same reference numerals, and a description of those elements will be omitted.

Figure 1:
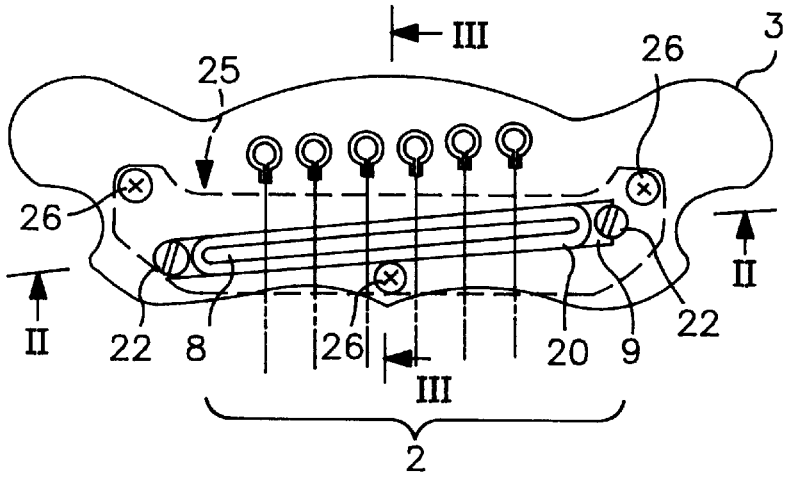
FIG. 1 is a top view showing one embodiment of the pick-up device attachment structure for an electrical stringed musical instrument according to the present invention.
Figure 2:
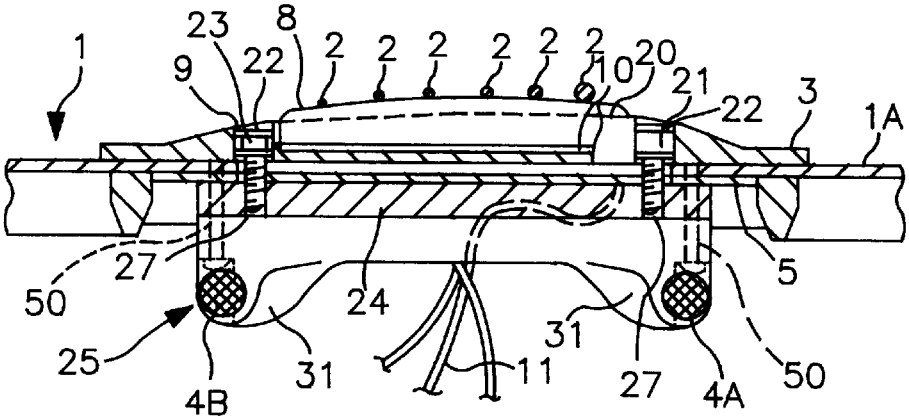
FIG. 2 is a sectional view taken along line II—II in FIG. 1.
Figure 4:
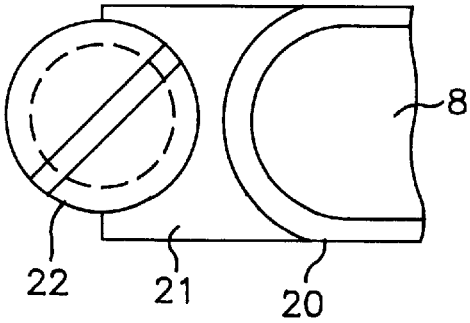
FIG. 4 is a top view of the essential portion of the casing supporting structure.
Figure 3:
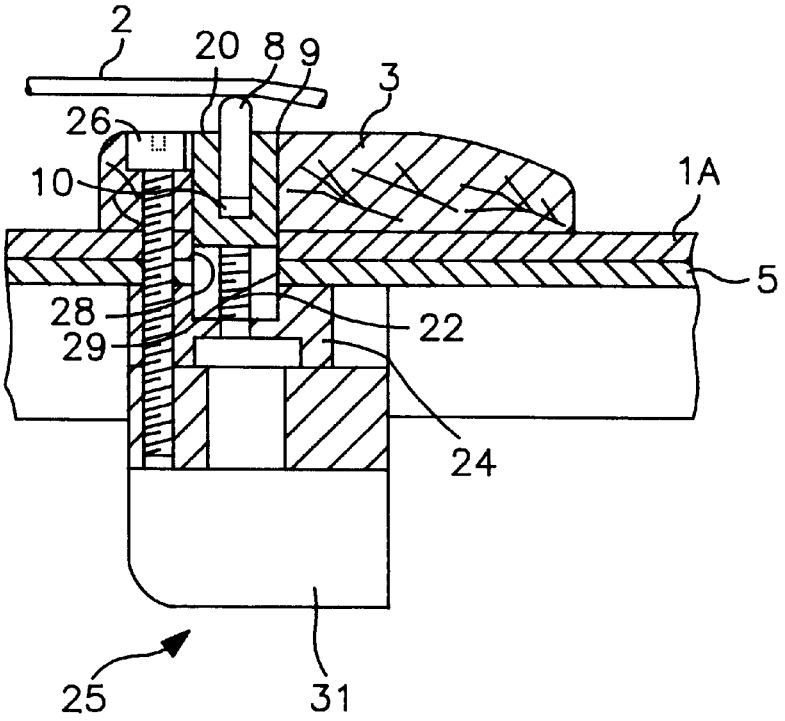
FIG. 3 is a sectional view taken along line III—III in FIG. 1.

In the typical embodiment shown in FIGS. 1 to 4, an accommodating section 9 is formed, as best seen from FIG. 3, in a lower bridge 3 that is attached to the outer surface of the front board 1A of the instrument. The accommodating section 9 is an elongated through-hole and opens in the upper and lower surfaces of the lower bridge 3; and a casing 20 which is provided therein with a pick-up device 10 and a string-carrying member or string carrier 8 (in that order) is accommodated in this accommodating section 9. The casing 20 in the accommodating section or the through-hole 9 can be raised and lowered (or moved up and down in FIG. 2 or in the direction perpendicular to the front board 1A) by turning adjustment screws 22 described below. The pick-up device 10 referred to above converts the vibrations of the strings 2, which are supported on the string-carrying member 8, into electrical signals.

The casing 20 is made of metal and is formed in an elongated, slender box shape having an open upper surface. It is accommodated in the accommodating section 9 so that the length of the casing 20 is in the direction perpendicular to the strings 2 as shown in FIG. 1.

Screw engagement sections 21 are formed, as shown in FIG. 2, at both ends (right and left end in FIG. 2) of the casing 20, and adjustment screws 22 which are a height adjustment means are respectively engaged with these screw engagement sections 21 so that the casing 20 is held in a stable fashion by the adjustment screws 22. More specifically, the adjustment screws 22 have annular grooves 23 in the outer circumferential surfaces of their head portions, and the adjustment screws 22 are engaged to the screw engagement sections 21 by way of these annular grooves 23.

A plate member 24 that is made of metal, for instance, aluminum, is fastened to the inner surface of the front board 1A (which forms the front surface of the resonating body 1 of the instrument) with a lower bridge reinforcing plate 5 positioned in between so that the plate member 24 positionally corresponds to the lower bridge 3. In addition, a microphone unit 25 is mounted to the under surface of the front board 1A via screws 50 so that the microphone unit 25 is positioned under (in FIG. 4) the plate member 24. The plate member 24 and the microphone unit 25 are further secured to the front board 1A by mounting screws 26. Reference numeral 4A and 4B are microphones, and they are fastened to the lower portion (in FIG. 2) of this microphone unit 25 so as to be located under the plate member 24. Furthermore, as best shown in FIG. 2, screw holes 27 are formed at both end portions of the plate member 24, and the adjustment screws 22 referred to above are screw engaged with these screw holes 27.

Accordingly, when the adjustment screws 22 are rotated, the casing 20 is moved upward or downward (in FIG. 2), and therefore, the height of the strings 2 supported on the string-carrying member 8 installed in the casing 20 can be moved upward and downward, thus being adjusted. Furthermore, since the casing 20 and string-carrying member 8 are constantly subjected to a pressing force by the tension of the strings 2, no clearance would occur where the adjustment screws 22, which are metal, are engaged with the screw holes 27 formed in the plate member 24.

Meanwhile, as shown in FIG. 3, openings 28 and 29 of the same size and shape as the accommodating section 9 of the lower bridge 3 are respectively formed in the front board 1A and lower bridge reinforcing plate 5.

The microphone unit 25 referred to above has microphone attachment sections 31 in both end portions of the lower portion (in FIG. 2) thereof so that filter-equipped microphones 4A and 4B for low-notes and high-notes which mainly pick up sound inside the resonating body 1 are securely attached to the microphone attachment sections 31. The reason for using the microphones 4A and 4B for the low-notes and high-notes in this way is that with such an arrangement it is possible to pick up an acoustically balanced sound and to obtain a stereo effect, etc. Furthermore, if the sound inside the resonating body 1 is directly picked up by the microphones 4A and 4B, the sensitivity thereof is too strong, and howling tends to occur. Accordingly, it is preferable to attach filters to the microphones 4A and 4B (thus forming filter-equipped microphones as described above) so as to reduce the sensitivity and prevent the howling. Furthermore, with the use of the filter-equipped microphones 4A and 4B, it is possible to pick up only the sound generated in the body 1 of the musical instrument (or guitar), and unnecessary sounds are not picked up; thus, unpleasant sounds can be eliminated.

As seen from the above, in the attachment structure for the pick-up device of the present invention, the pick-up device 10 and string-carrying member 8 are installed inside the casing 20, and the thus formed casing 20 is accommodated inside the accommodating section 9 of the lower bridge 3 so that the casing 20 can be raised and lowered, and the height of the raised or lowered casing 20 is set by rotating the adjustment screws 22. Accordingly, there is no need to plan the string-carrying member 8 for executing the height adjustment, and the height of the strings 2 can be adjusted quickly and easily by raising or lowering the casing 20. Furthermore, since the pick-up device 10 is installed inside the casing 20, it is not necessary that the pick-up device 10 be in tight contact with a groove formed in the lower bridge 3, which is made of wood. As a result, a good tone color, sound volume and playing characteristics, etc. are obtainable. Moreover, since the adjustment screws 22 are screwed into screw holes 27 formed in the metal plate member 24, the adjustment screws 22 are held in a stable fashion.

Furthermore, the microphones 4A and 4B are securely attached to the microphone unit 25; accordingly, they do not fall off. In addition, since the plate member 24 that has a height adjustment function and the microphone unit 25 that has a microphone attachment function are both mounted to the front board 1A by screws 26, assembly during manufacture of stringed musical instruments is easier.

In the embodiment described above, the accommodating section 9 formed in the lower bridge 3 is a through-hole as seen from FIG. 3. However, the present invention is not limited to this structure; and it would be possible to form the accommodating section in a form of a recess.

As described above, the stringed musical instrument pick-up device attachment structure of the present invention includes a casing, which is accommodated inside the accommodating section of the lower bridge in a manner that the casing can be raised and lowered, and a height adjustment means, which adjusts the height of the casing; and in addition, a pick-up device and a string-carrying member are installed inside the casing. Accordingly, the inside bottom surface of the accommodating section of the lower bridge does not need to be a surface with a high degree of flatness. In addition, the height of the strings can be quickly and easily adjusted without any need to plan the string-carrying member. Thus, it is possible to improve the tone color, sound volume and playing characteristics. Moreover, since the adjustment screws are screwed into a metal plate member, the adjustment screws can be stable and prevented from coming out.

Furthermore, since the microphones are fastened to the microphone unit, they are more secure thereon than in cases where putty is used; and there is no danger that the microphones will fall off. In addition, since the plate member that has a height adjustment function and the microphone unit that has a microphone attachment function are both mounted to the front board by screws, assembly during manufacture of stringed musical instruments is easier.

I claim:

1. An attachment structure for a pick-up device for an electrical stringed musical instrument comprising a lower bridge fastened to an outer surface of a front board of said instrument, a pick-up device and a string-carrying member provided inside an accommodating section of said lower bridge, an upper surface of said string-carrying member for supporting strings of said instrument, a casing movably accommodated inside said accommodating section of said lower bridge, and a height adjustment means for adjusting a height of said casing; and wherein said pick-up device and string-carrying member are installed inside said casing.

2. An attachment structure according to claim 1, further comprising a plate member mounted to an inner surface of said front board so a to positionally correspond to said lower bridge, and said height adjustment means comprises adjustment screws screwed into said plate member.

3. An attachment structure according to claim 1, further comprising a microphone unit mounted on an inner surface of said front board, said microphone unit being provided with microphones.

4. An attachment structure for a pick-up device of an electrical stringed musical instrument comprising:

a bridge member provided on an outer surface of a front board of said musical instrument, said bridge member being provided with an elongated through-hole;

an elongated casing accommodated in said elongated trough-hole of said bridge member so that said casing is movable in a direction perpendicular to said front board, said casing being provided with engagement holes at both ends thereof;

a pick-up device and a string-carrying member installed in said casing so that strings of said musical instrument are supported on said string-carrying member and said pick-up device is coupled to said string-carrying member;

screw means for being inserted into said engagement holes of said elongated casing; and a plate member provided on an inner surface of said front board of said musical instrument, said plate member being formed with screw holes so that said screw means engaging with said engagement holes of said casing are screw-engaged with said screw holes;

whereby a height of said casing is adjusted by said screw means.

5. An attachment structure according to claim 4, further comprising a microphone unit mounted to said inner surface of said front board with said plate member in between, said microphone member being provided with a pair of filter-equipped microphones for picking up sound inside a resonating body of said musical instrument.

* * * * *